US008913912B2

(12) United States Patent
Monahan et al.

(10) Patent No.: US 8,913,912 B2
(45) Date of Patent: Dec. 16, 2014

(54) METHOD AND APPARATUS FOR A PRINT JOB TYPE DEPENDENT RELEASE AGENT APPLICATION

(75) Inventors: Melissa Ann Monahan, Rochester, NY (US); Erwin Ruiz, Rochester, NY (US); Steven Russel, Bloomfield, NY (US); Jeffrey Nyyssonen Swing, Rochester, NY (US); Christopher Alan Jensen, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 118 days.

(21) Appl. No.: 13/525,215

(22) Filed: Jun. 15, 2012

(65) Prior Publication Data

US 2013/0336673 A1 Dec. 19, 2013

(51) Int. Cl.
*G03G 15/00* (2006.01)

(52) U.S. Cl.
USPC ..... 399/82

(58) Field of Classification Search
USPC ..... 399/82, 325, 326, 327
See application file for complete search history.

(56) References Cited

U.S. PATENT DOCUMENTS 5,132,739 A * 7/1992 Mauer et al. ..... 399/325
2011/0318072 A1 12/2011 Barton et al.

FOREIGN PATENT DOCUMENTS

JP 06110351 A * 4/1994

OTHER PUBLICATIONS

Translation of JP06-110351A, pub date Apr. 22, 1994, to Sakurai et al.*

U.S. Appl. No. 13/284,392; Fromm et al.; filed Oct. 28, 2011; Methods and Systems for Establishing Steady State Adjusted Release Fluid Rate Before Sheet Processing at a Fusing NIP.

* cited by examiner

*Primary Examiner* — Quana M Grainger
(74) *Attorney, Agent, or Firm* — Ronald E. Prass, Jr.; Prass LLP

(57) ABSTRACT

An approach is provided for applying a release agent to a substrate having at least a first surface and a second surface. The approach involves determining a print job type for applying one or more printed images to the substrate to be one of a simplex print job type that applies the one or more printed images to one of the first surface and the second surface and a duplex print job type that applies the one or more printed images to the first surface and the second surface. The approach also involves processing the determined print job type to cause, at least in part, a determination of a release agent application instruction that corresponds with the determined print job type. The approach further involves causing, at least in part, an amount of the release agent to be applied to the substrate based on the release agent application instruction.

14 Claims, 4 Drawing Sheets

METHOD AND APPARATUS FOR A PRINT JOB TYPE DEPENDENT RELEASE AGENT APPLICATION

FIELD OF DISCLOSURE

The disclosure relates to a method and apparatus for applying a release agent useful in printing to a substrate. An amount of release agent that is applied to the substrate is based on a determined print job type.

BACKGROUND

Various printing processes in which a substrate is processed by a fuser unit often involve applying a release agent such as an oil to a substrate upon which an image is printed to aid in stripping the substrate from a fuser roll, for example, and/or to protect the fuser roll from contaminants. The application of release agent often results in increased usage life of a fuser roll and reduced contamination compared to an untreated fuser roll. The application of release agent is also often applied to prevent image offset that may occur. Image offset often occurs from the printed substrate to various parts of printing apparatuses and/or finishing equipment such as, but not limited to, rollers, photoreceptor belts, winders, unwinders, die cutters, buffers, stackers, back sides of rolled and/or stacked printed substrates, etc.

Conventionally, a release agent application module that may be part of a fuser unit applies a thin layer of oil to a fuser roll, for example, to enable the substrate to strip from the fuser roll when exiting a fuser portion of the fuser unit. While oil works well as a lubricant, aids in stripping the paper from the fuser roll, and reduces any amounts of contaminants that may stick to the fuser roll, oil can also be carried back to a photoreceptor belt, and cause image related defects.

Various conventional fuser units often offer both simplex and duplex printing job type options. For example, simplex printing refers to a printing process in which a substrate having a first surface and a second surface has an image printed on only one of the first surface and the second surface. Duplex printing refers to a printing process in which a substrate having a first surface and a second surface has an image printed on both the first surface and the second surface.

Conventional fuser units are configured to flood coat the first surface and/or the second surface, as instructed, with a same amount of release agent, regardless of whether the substrate is subjected to a simplex or duplex printing process. Such flood coating of both surfaces often results in excessive amounts of release agent being carried back to unwanted portions of the fuser unit, resulting in various image defects, as discussed above.

SUMMARY

Therefore, there is a need for an approach for applying an amount of release agent to a substrate based on a determined print job type.

According to one embodiment, a method for applying a release agent to a substrate processed by a fuser unit comprising at least a first roller and a second roller, the substrate having at least a first surface associated with the first roller and a second surface associated with the second roller, comprises determining a print job type for applying one or more printed images to the substrate to be one of a simplex print job type that applies the one or more printed images to one of the first surface and the second surface and a duplex print job type that applies the one or more printed images to the first surface and the second surface. The method also comprises processing the determined print job type to cause, at least in part, a determination of a release agent application instruction that corresponds with the determined print job type. The method further comprises causing, at least in part, an amount of the release agent to be applied to the substrate based, at least in part, on the release agent application instruction.

According to another embodiment, an apparatus useful in printing comprises at least one processor, and at least one memory including computer program code for one or more computer programs, the at least one memory and the computer program code configured to, with the at least one processor, cause, at least in part, the apparatus to determine a print job type for applying one or more printed images to a substrate processed by a fuser unit comprising at least a first roller and a second roller, the substrate having at least a first surface associated with the first roller and a second surface associated with the second roller, to be one of a simplex print job type that applies the one or more printed images to one of the first surface and the second surface and a duplex print job type that applies the one or more printed images to the first surface and the second surface. The apparatus is also caused to process the determined print job type to cause, at least in part, a determination of a release agent application instruction that corresponds with the determined print job type. The apparatus is further caused to cause, at least in part, an amount of the release agent to be applied to the substrate based, at least in part, on the release agent application instruction.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method, apparatus, and computer program for applying an amount of release agent to a substrate based on a determined print job type are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term simplex printing, or any derivation thereof, refers to a printing process in which a substrate having a first surface and a second surface has an image printed on only one of the first surface and the second surface.

As used herein, the term duplex printing, or any derivation thereof, refers to a printing process in which a substrate having a first surface and a second surface has an image printed on both the first surface and the second surface.

As used herein, "fuser unit" shall apply to any apparatus having the effect of applying predetermined amounts of heat and/or pressure to a print sheet for any purpose. Typically, in xerographic printing, the fuser unit serves to partially melt powdered toner onto the print sheet, thereby yielding a substantially permanent image. In other applications, applied heat and/or pressure can be used for other specific purposes, such as to level and/or at least partially dry an ink jet image.

Figure 1:
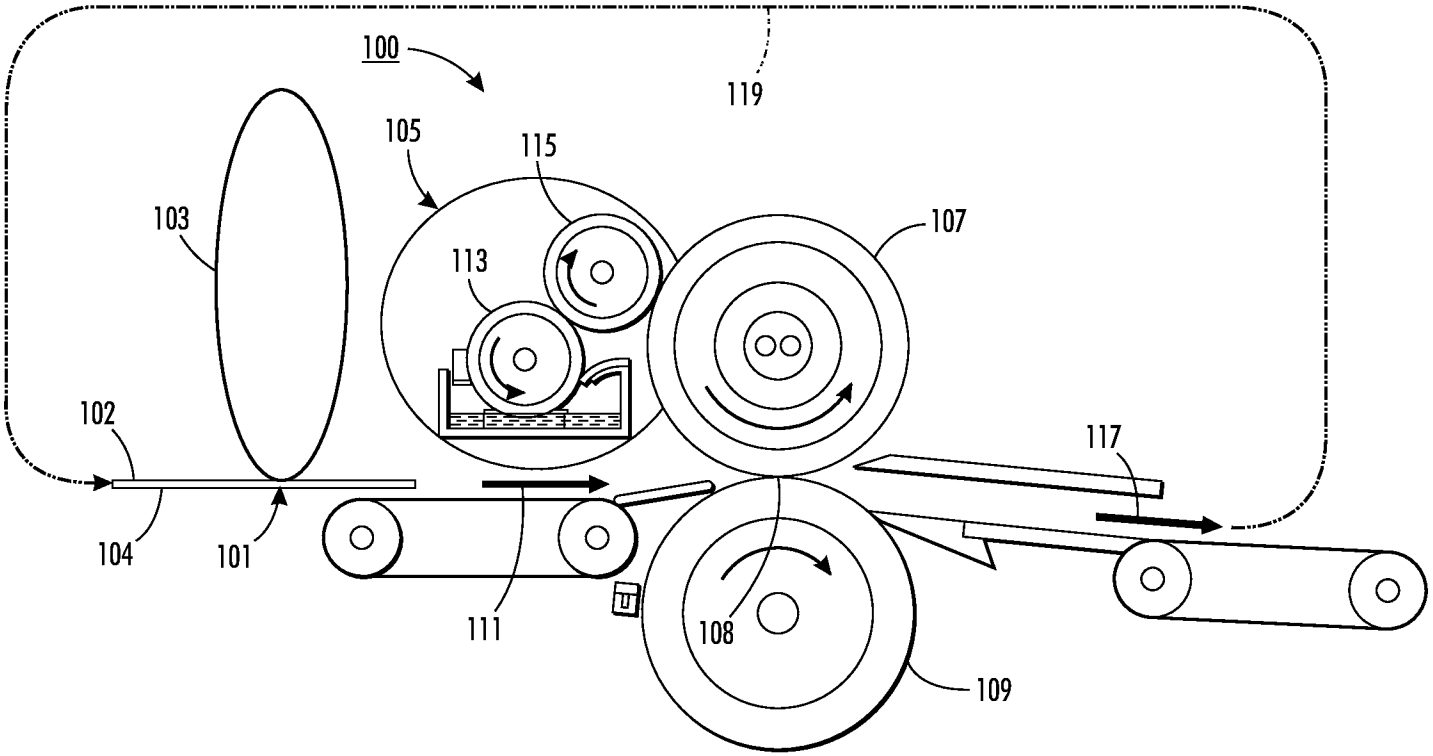
FIG. 1 is a diagram of a system capable of applying an amount of release agent to a substrate based on a determined print job type, according to one embodiment.

FIG. 1 is a diagram of a system capable of applying an amount of release agent to a substrate based on a determined print job type, according to one embodiment.

Conventional fuser units are configured to flood coat the first surface and/or the second surface of a substrate with a same amount of release agent, regardless of whether the substrate is subjected to a simplex or duplex printing process. Such flood coating during duplex printing, however, results in excessive amounts of release agent being applied to the substrate that is carried back to unwanted portions of the fuser unit such as a photoreceptor belt, for example, resulting in various image defects, as discussed above. Over use of release agent often results in print process delays and efficiency reduction as well. For example, a printing process may need to be stopped and started or delayed to correct any image related defects that are observed.

To address these problems, a fuser unit 100 of FIG. 1 introduces the capability to apply an amount of release agent to a substrate based on a determined print job type. According to various embodiments, as will be discussed in more detail below, the fuser unit 100 is configured to vary an amount of release agent that is applied to a substrate based upon a determination of whether the substrate is subjected to simplex or duplex printing. For example, a simplex print job type may have a set release agent application rate which may be predetermined as a benchmark value from which a release agent application rate for a duplex print job type may be comparatively reduced for one or both side of the substrate. Such a reduction in release agent application rate for duplex print job types causes a reduction in the amount of release agent that is carried back to unwanted portions of the fuser unit 100, and accordingly mitigates the aforementioned image defects. Additionally, a reduction in release agent application rate for one or both sides of the substrate for duplex print job types compared to simplex print job types, causes overall usage quantities of release agent to be reduced compared to conventional fuser units. The reduction in release agent usage saves both time and money. For example, less release agent is used for any number of printing processes which reduces the number of times a printing process must be stopped or delayed, for example, because a release agent supply must be replenished.

As shown in FIG. 1, the fuser unit 100 is configured to print one or more images on a substrate 101 having a first surface 102 and a second surface 104 by any of simplex or duplex printing. According to various embodiments, the fuser unit 100 comprises a photoreceptor belt 103, a release agent application module 105, and a fuser roll 107 that forms a fusing nip 108 with a pressure roll 109.

In one or more embodiments, the photoreceptor belt 103 is configured to apply one or more images to the first surface 102 and/or the second surface 104 of substrate 101, depending on whether the substrate is to be subjected to simplex or duplex printing. Any image applied to the substrate 101, however, may be applied by any means that may be in addition to, or as an alternative of, being applied by the photoreceptor belt 103, such as, for example, inkjet printing or one or more other photoreceptor belts. In this example, the substrate 101 having an applied image moves through the fuser unit 100 from the photoreceptor belt 103 to the fusing nip 108 in a process direction. 111.

The release agent application module 105, comprises a metering roll 113 and a donor roll 115. The donor roll 115 applies release agent to the fuser roll 107, such that when the substrate 101 passes through the fusing nip 108, release agent is applied to the surface of substrate 101 that contacts the fuser roll 107 in the fusing nip 108. In this example, the surface that contacts the fuser roll 107 in the fusing nip 108 is the first surface 102, but the surface that contacts the fuser roll 107 may be the second surface 104 in alternative embodiments. Once the substrate 101 passes through the fusing nip 108, the image applied to the substrate 101 is fused to the substrate 101 and coated with release agent supplied by the release agent application module 105. The release agent applied to the substrate 101 aids in stripping the substrate from the fuser roll 107, protects the fuser roll 107 from contaminants, and may also provide protection to other portions of the fuser unit 100, as well as off-line finishing equipment, from image offset. The substrate 101, having the fused image and release agent coated surface, then progresses through the fuser unit 100 in a process direction 117. It should be noted that the release agent application module 105, though illustrated as having a metering roll 113 and a donor roll 115, may comprise any number of features such as the example rolls 113, 115, sprayers, drip tubes, alternative or additional rollers, etc., or any combination thereof. Additionally, the release agent application module may be configured to apply release agent to any of the first surface 102 and second surface 104 directly without first supplying release agent to the fuser roll 107. It should be noted that either surface, although shown as associated with rollers in the illustrated embodiment, can be associated with belts or stationary surfaces in various possible embodiments.

If the substrate 101 is subjected to simplex printing, the substrate 101, having the fused image is caused to proceed through the fuser unit 100 to completion, or onto any finishing steps that may follow the fusing process described above.

Alternatively, if the substrate is to be subjected to duplex printing, the substrate 101, in this example, is routed back to the fuser unit 100 in duplex printing process direction 119 and inverted such that one or more other images may be applied to the other of the first surface 102 and the second surface 104 of the substrate 101. In this example, the another image is applied to the second surface 104. While the fuser unit 100 illustrates duplex printing process direction 119 as being a process that reruns the substrate 101 through the fuser unit 100 such that the same photoreceptor belt 103 applies the one or more other images to the substrate 101, the fuser unit 100 may be of any configuration that may apply another image to the substrate 101, such as, for example, using another photoreceptor belt, another release agent application module, another fuser roll, another pressure roll, or any combination thereof, that may be located downstream of the illustrated fusing nip 108, or another photoreceptor belt that is configured to apply one or more images at the same time as the photoreceptor belt 103, or any time upstream of the photoreceptor belt 103, for example such that the substrate 101 need not follow duplex printing process direction 119 to be rerun.

In this example, however, once the one or more other images are applied to the second surface 104 of substrate 101, the substrate 101 again moves in the process direction 111 through the fusing nip 108 upon which release agent is applied by the fuser roll 107 to the second surface 104, as provided by the release agent application module 105.

To mitigate the above-mentioned image defects for duplex printing, the release agent application module 105 may cause a reduced amount of release agent to be applied to the substrate 101 for one or both passes of the substrate 101 through the fusing nip 108, for example, or applied directly to the substrate 101 or by any number of fusing nips, for example.

For example, the fuser unit 100 may instruct the release agent application module 105 as to how much release agent is to be applied to the substrate 101 based on the instructed or determined print job type whether simplex or duplex. As a default, the amount of release agent applied to the substrate 101 may be set at a predetermined value for simplex printing. For example, for simplex printing, the release agent application rate may be set as a benchmark value that is in a range of 5 mg/A3 paper size to 20 mg/A3 paper size. In other embodiments, the release agent application rate may be set as a benchmark value that is in a range of 7 mg/A3 paper size to 17 mg/A3 paper size. In further embodiments, the release agent application rate may be set as a benchmark value that is in a range of 8 mg/A3 paper size to 14 mg/A3 paper size. Accordingly, in one or more embodiments, if the print job type is determined to be a simplex print job type, the release agent application module 105 causes an amount of release agent to be applied to the substrate 101 that is in accordance with the benchmark release agent application value.

Because the release agent may be carried back to the photoreceptor belt 103, for example, if a duplex print job type is determined, the release agent application module is configured to reduce the amount of release agent applied to the substrate 101 so that upon the benchmark release agent application value that is preset for simplex printing is not applied to one or both of the first surface 102 and second surface 104 of substrate 101. For example, the duplex release agent application value may be in a range of 4 mg/A3 paper size to 8 mg/A3 paper size. In other embodiments, the duplex release agent application value may be in a range of 5 mg/A3 paper size to 7 mg/A3 paper size.

In one or more embodiments, if the print job type is determined to be a duplex print job type, the release agent application module 105 causes release agent to be applied to the substrate 101 such that when the substrate 101 makes its first pass through the fusing nip 108, the benchmark value release agent application value for simplex printing is applied to the first surface 102 of substrate 101. Then upon the second pass through the fusing nip 108, for example, or as otherwise applied as discussed above in alternative embodiments, the release agent is applied to the second surface 104 in accordance with the reduced duplex release agent application value.

Alternatively, if the print job type is determined to be a duplex print job type, the release agent application module, causes release agent to be applied to the substrate 101 such that the release agent applied to both of the first surface 102 and the second surface 104 of the substrate 101 is in accordance with the duplex release agent application value on both passes through the fusing nip 108, for example, or as otherwise applied as discussed above in alternative embodiments. According to various embodiments, the release agent application module 105 may be caused to change the amount of release agent applied to any surface of the substrate 101 on demand in accordance with any of the above-mentioned methods for applying the release agent to enable adjustments on the fly to mitigate any observed image related defects. For example, the release agent application module 105 may be instructed to adjust the amount of release agent applied to the first surface 102 and the second surface 104 to be different or the same during a duplex printing process.

Figure 2:
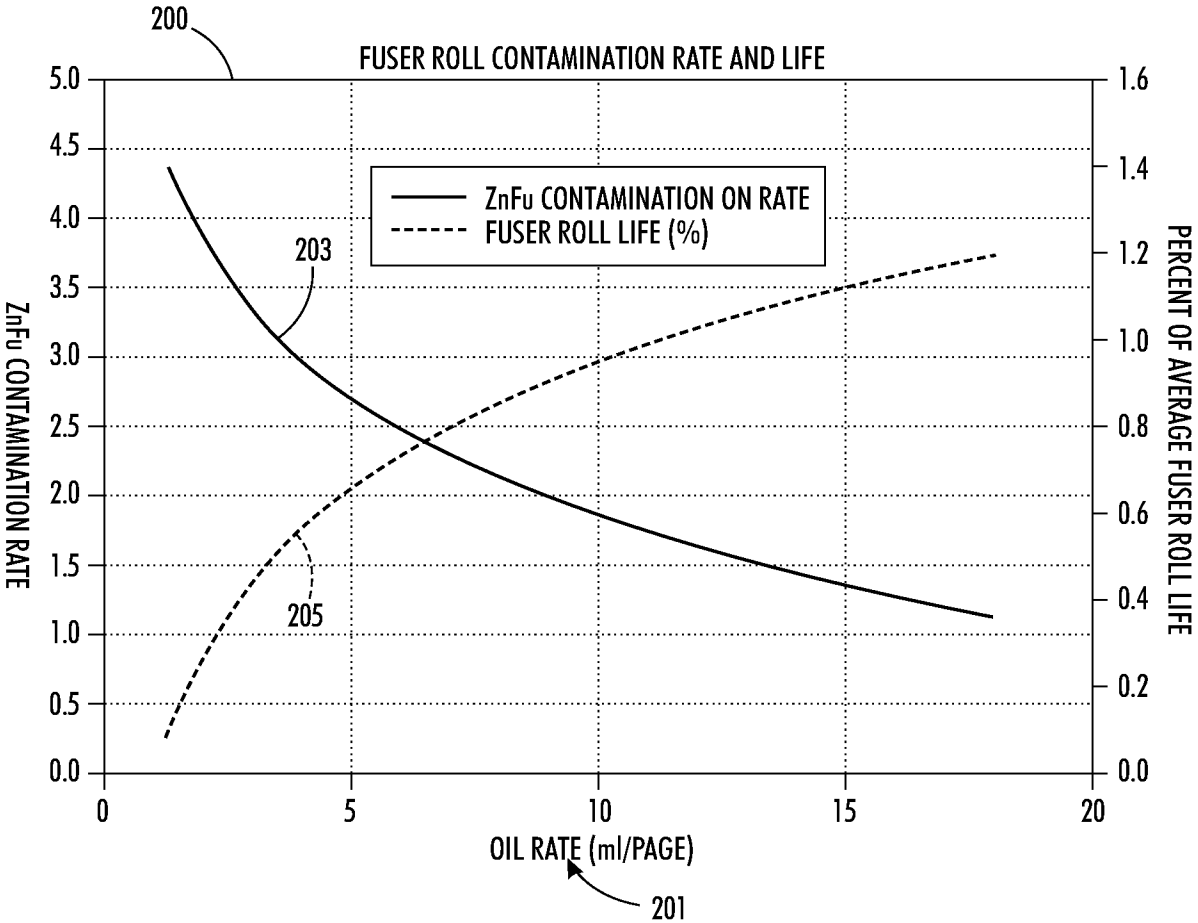
FIG. 2 is a chart illustrating the effects of applying release agent to a substrate, according to one embodiment.

FIG. 2 illustrates a chart 200 that shows the effects that the release agent application value has on contaminant reduction and fuser roll life. Release agent, as discussed above, is applied to the substrate 101 to increase fuser roll life, aid in stripping, protect downstream portions of the fuser unit 100 and any finishing equipment, and to reduce contamination of the fuser roll 107. While applying release agent during duplex printing causes the release agent to be carried back to portions of the fuser unit 100, this issue not apparent for simplex printing. Accordingly, there is still a need to apply some amount of release agent to the substrate 101 in the case of simplex printing when the issues caused by duplex printing are of no concern, therefore the fuser unit 100 may be configured to accommodate both simplex release agent application instructions and duplex release agent application instructions.

For example, chart 200 illustrates the effects that release agent application rate 201 has on both ZnFu contamination rate 203 and fuser roll life percentage 205. An increase in release agent application rate 201 causes a decrease in ZnFu contamination rate 203, which exemplifies a reduction of how the fuser roll 107 may experience contamination by any substance. An increase in release agent application rate 201 also causes an increase in fuser roll life percentage 205.

As discussed above, the fuser unit 100, discussed in FIG. 1, is configured to subject the substrate 101 to any of simplex and duplex printing on demand so that the fuser unit 100 can reap the benefits of both higher-volume release agent application for simplex printing, and reduced release agent application amounts for duplex printing.

Figure 3:
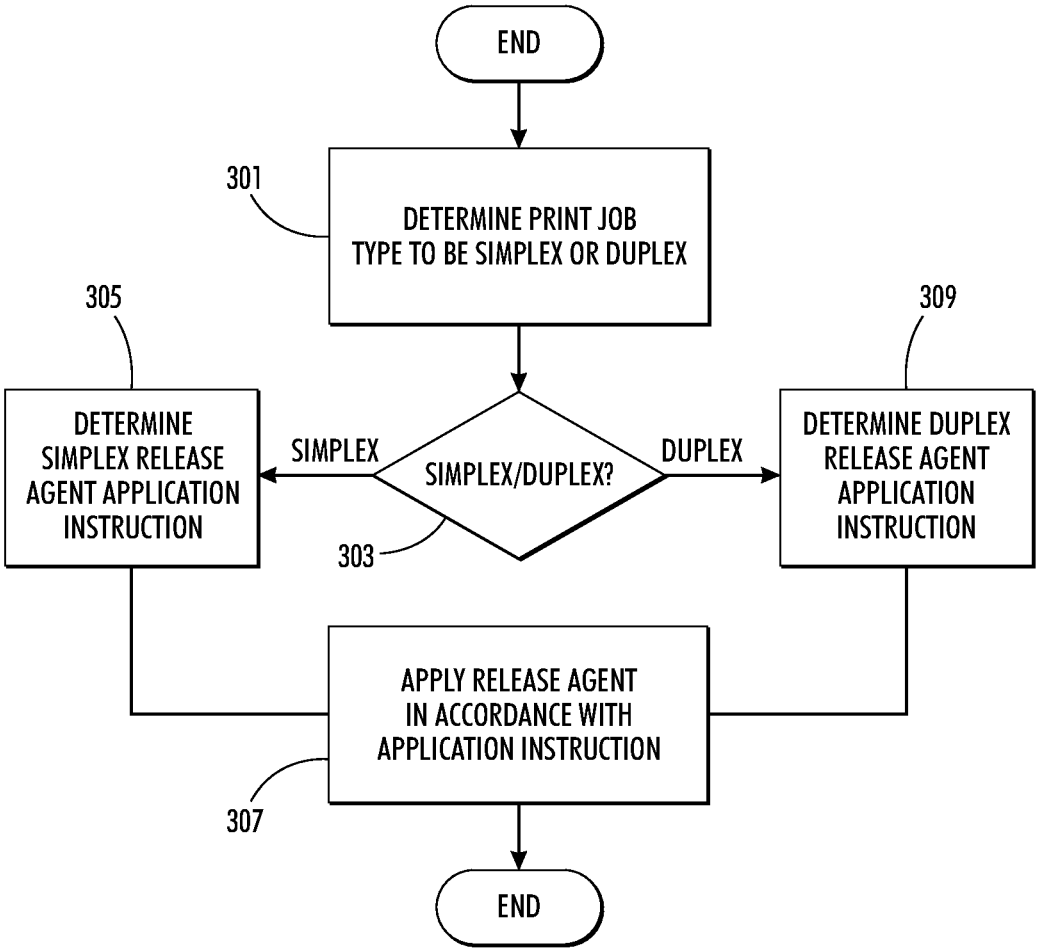
FIG. 3 is a flowchart of a process for applying an amount of release agent to a substrate based on a determined print job type, according to one embodiment.
Figure 4:
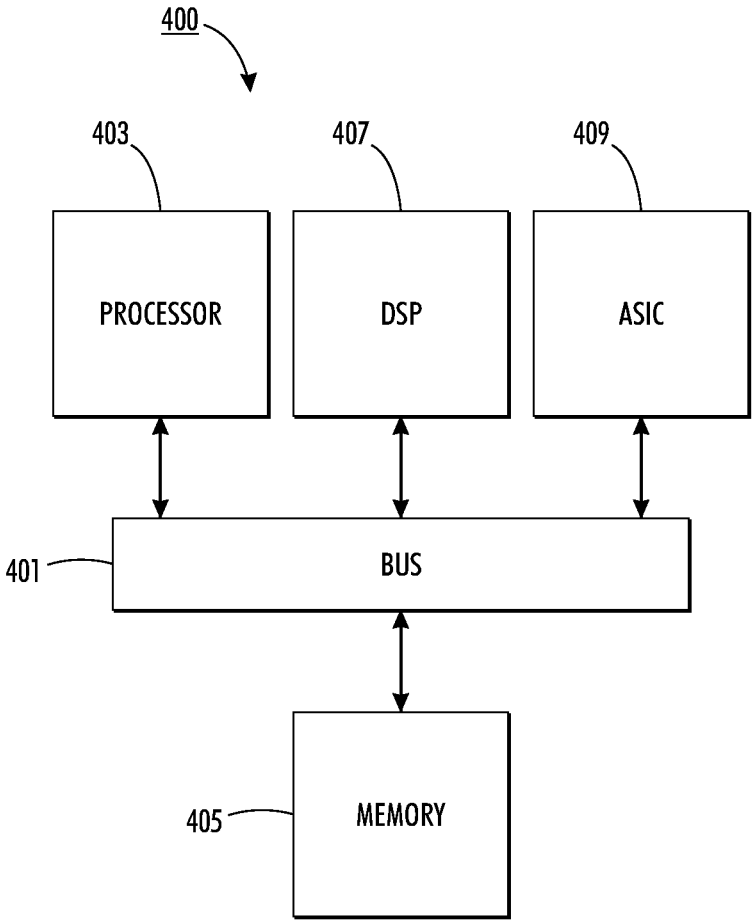
FIG. 4 is a diagram of a chip set that can be used to implement an embodiment.

FIG. 3 is a flowchart of a process for applying an amount of release agent to a substrate based on a determined print job type, according to one embodiment. In one embodiment, the fuser unit 100, or at least the release agent application module 105, discussed above, performs the process 300, which may be implemented in, for instance, a chip set including a processor and a memory as shown in FIG. 4. In step 301, the fuser unit 100 determines a print job type for applying one or more printed images to the substrate 101 discussed above having a first surface 102 and a second surface 104 to be one of a simplex print job type that applies the one or more printed images to one of the first surface 102 and the second surface 104 and a duplex print job type that applies the one or more printed images to the first surface 102 and the second surface 104. Then, in step 303, the determined print job type is processed. If the print job type is a simplex print job type, the process continues to step 305 in which a simplex release agent application instruction is determined.

According to various embodiments, the simplex print job type instruction comprises a benchmark release agent application value for the amount of release agent to be applied to the substrate 101 for the simplex print job type. In one or more embodiments, the benchmark release agent application value is in a range of 5 mg/A3 paper size to 20 mg/A3 paper size. In one or more other embodiments, the benchmark release agent application value is in a range of 7 mg/A3 paper size to 17 mg/A3 paper size. In one or more further embodiments, the benchmark release agent application value is in a range of 8 mg/A3 paper size to 14 mg/A3 paper size.

Then, in step 307, an amount of the release agent is caused to be applied to the substrate 101 based, at least in part, on the simplex release agent application instruction.

If the print job type is a duplex print job type, the process continues to step 309 in which a duplex release agent application instruction is determined. According to various embodiments, the duplex print job type instruction comprises a duplex release agent application value that is less than the benchmark release agent application value for the amount of release agent to be applied to the substrate 101 for the duplex print job type.

In one or more embodiments, if the determined print job type is a duplex print job type, the amount of release agent applied to the substrate 101 is such that the duplex release agent application value is applied to one of the first surface 102 and the second surface 104, and the amount of release agent applied to the other of the first surface 102 and the second surface 104 to be equal to the benchmark release agent application value Alternatively, in one or more embodiments, if the determined print job type is a duplex print job type, the amount of release agent applied to the substrate 101 is such that the duplex release agent application value is applied to both the first surface 102 and the second surface 104. According to various embodiments, the duplex release agent application value is in a range of 4 mg/A3 paper size to 8 mg/A3 paper size. In one or more other embodiments, the duplex release agent application value is in a range of 5 mg/A3 paper size to 7 mg/A3 paper size.

Then, in step 307, an amount of the release agent is caused to be applied to the substrate based, at least in part, on the duplex release agent application instruction.

The processes described herein for applying an amount of release agent to a substrate based on a determined print job type may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 4 illustrates a chip set or chip 400 upon which an embodiment may be implemented. Chip set 400 is programmed to apply an amount of release agent to a substrate based on a determined print job type as described herein may include, for example, bus 401, processor 403, memory 405, DSP 407 and ASIC 409 components.

The processor 403 and memory 405 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 400 can be implemented in a single chip. It is further contemplated that in certain embodiments the chip set or chip 400 can be implemented as a single "system on a chip." It is further contemplated that in certain embodiments a separate ASIC would not be used, for example, and that all relevant functions as disclosed herein would be performed by a processor or processors. Chip set or chip 400, or a portion thereof, constitutes a means for performing one or more steps of applying an amount of release agent to a substrate based on a determined print job type.

In one or more embodiments, the chip set or chip 400 includes a communication mechanism such as bus 401 for passing information among the components of the chip set 400. Processor 403 has connectivity to the bus 401 to execute instructions and process information stored in, for example, a memory 405. The processor 403 may include one or more processing cores with each core configured to perform independently. A multi-core processor enables multiprocessing within a single physical package. Examples of a multi-core processor include two, four, eight, or greater numbers of processing cores. Alternatively or in addition, the processor 403 may include one or more microprocessors configured in tandem via the bus 401 to enable independent execution of instructions, pipelining, and multithreading. The processor 403 may also be accompanied with one or more specialized components to perform certain processing functions and tasks such as one or more digital signal processors (DSP) 407, or one or more application-specific integrated circuits (ASIC) 409. A DSP 407 typically is configured to process real-world signals (e.g., sound) in real time independently of the processor 403. Similarly, an ASIC 409 can be configured to perform specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 403 performs a set of operations on information as specified by computer program code related to applying an amount of release agent to a substrate based on a determined print job type. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 401 and placing information on the bus 401. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 403, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 403 and accompanying components have connectivity to the memory 405 via the bus 401. The memory 405 may include one or more of dynamic memory (e.g., RAM, magnetic disk, writable optical disk, etc.) and static memory (e.g., ROM, CD-ROM, etc.) for storing executable instructions that when executed perform the inventive steps described herein to apply an amount of release agent to a substrate based on a determined print job type. The memory 405 also stores the data associated with or generated by the execution of the inventive steps.

In one or more embodiments, the memory 405, such as a random access memory (RAM) or any other dynamic storage device, stores information including processor instructions for applying an amount of release agent to a substrate based on a determined print job type. Dynamic memory allows information stored therein to be changed by fuser unit 100. RAM allows a unit of information stored at a location called a memory address to be stored and retrieved independently of information at neighboring addresses. The memory 405 is also used by the processor 403 to store temporary values during execution of processor instructions. The memory 405 may also be a read only memory (ROM) or any other static storage device coupled to the bus 401 for storing static information, including instructions, that is not changed by the fuser unit 100. Some memory is composed of volatile storage that loses the information stored thereon when power is lost. The memory 405 may also be a non-volatile (persistent) storage device, such as a magnetic disk, optical disk or flash card, for storing information, including instructions, that persists even when the fuser unit 100 is turned off or otherwise loses power.

The term "computer-readable medium" as used herein refers to any medium that participates in providing information to processor 403, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method for applying a release agent to a substrate processed by a fuser unit comprising at least a first roller and a second roller, the substrate having at least a first surface associated with the first roller and a second surface associated with the second roller, the method comprising:

determining a print job type for applying one or more printed images to the substrate to be one of a simplex print job type that applies the one or more printed images to one of the first surface and the second surface and a duplex print job type that applies the one or more printed images to the first surface and the second surface;

processing the determined print job type to cause, at least in part, a determination of a release agent application instruction that corresponds with the determined print job type; and causing, at least in part, an amount of the release agent to be applied to the substrate based, at least in part, on the release agent application instruction, wherein a simplex print job type instruction comprises a benchmark release agent application value for the amount of release agent to be applied to the substrate for the simplex print job type, wherein a duplex print job type instruction comprises a duplex release agent application value that is less than the benchmark release agent application value for the amount of release agent to be applied to the substrate for the duplex print job type;

wherein when the determined print job type is a duplex print job type, further comprising:

causing, at least in part, the amount of release agent applied to the substrate to be such that duplex release agent application value is applied to one of the first surface and the second surface; and causing, at least in part, the amount of release agent applied to the other of the first surface and the second surface to be equal to the benchmark release agent application value.

2. A method of claim 1, wherein the determined print job type is a duplex print job type, further comprising:

causing, at least in part, the amount of release agent applied to the substrate to be such that duplex release agent application value is applied to both the first surface and the second surface.

3. A method of claim 1, wherein the benchmark release agent application value is in a range of 5 mg/A3 paper size to 20 mg/A3 paper size.

4. A method of claim 3, wherein the benchmark release agent application value is in a range of 7 mg/A3 paper size to 17 mg/A3 paper size.

5. A method of claim 4, wherein the benchmark release agent application value is in a range of 8 mg/A3 paper size to 14 mg/A3 paper size.

6. A method of claim 1, wherein the duplex release agent application value is in a range of 4 mg/A3 paper size to 8 mg/A3 paper size.

7. A method of claim 6, wherein the duplex release agent application value is in a range of 5 mg/A3 paper size to 7 mg/A3 paper size.

8. An apparatus useful in printing comprising:

at least one processor; and at least one memory including computer program code for one or more programs, the at least one memory and the computer program code configured to, with the at least one processor, cause the apparatus to perform at least the following:

determine a print job type for applying one or more printed images to a substrate processed by a fuser unit comprising at least a first roller and a second roller, the substrate having at least a first surface associated with the first roller and a second surface associated with the second roller, to be one of a simplex print job type that applies the one or more printed images to one of the first surface and the second surface and a duplex print job type that applies the one or more printed images to the first surface and the second surface;

process the determined print job type to cause, at least in part, a determination of a release agent application instruction that corresponds with the determined print job type; and cause, at least in part, an amount of the release agent to be applied to the substrate based, at least in part, on the release agent application instruction, wherein a simplex print job type instruction comprises a benchmark release agent application value for the amount of release agent to be applied to the substrate for the simplex print job type, wherein a duplex print job type instruction comprises a duplex release agent application value that is less than the benchmark release agent application value for the amount of release agent to be applied to the substrate for the duplex print job type;

wherein when the determined print job type is a duplex print job type, and the apparatus is further caused to:

cause, at least in part, the amount of release agent applied to the substrate to be such that duplex release agent application value is applied to one of the first surface and the second surface; and cause, at least in part, the amount of release agent applied to the other of the first surface and the second surface to be equal to the benchmark release agent application value.

9. An apparatus of claim 8, wherein the determined print job type is a duplex print job type, and the apparatus is further caused to:

cause, at least in part, the amount of release agent applied to the substrate to be such that duplex release agent application value is applied to both the first surface and the second surface.

10. An apparatus of claim 8, wherein the benchmark release agent application value is in a range of 5 mg/A3 paper size to 20 mg/A3 paper size.

11. An apparatus of claim 10, wherein the benchmark release agent application value is in a range of 7 mg/A3 paper size to 17 mg/A3 paper size.

12. An apparatus of claim 11, wherein the benchmark release agent application value is in a range of 8 mg/A3 paper size to 14 mg/A3 paper size.

13. An apparatus of claim 8, wherein the duplex release agent application value is in a range of 4 mg/A3 paper size to 8 mg/A3 paper size.

14. An apparatus of claim 13, wherein the duplex release agent application value is in a range of 5 mg/A3 paper size to 7 mg/A3 paper size.

* * * * *